US011266886B2

(12) United States Patent
Stokke et al.

(10) Patent No.: US 11,266,886 B2
(45) Date of Patent: Mar. 8, 2022

(54) GOLF CLUB HEADS WITH TRENCH FEATURES AND RELATED METHODS

(71) Applicant: KARSTEN MANUFACTURING CORPORATION, Phoenix, AZ (US)

(72) Inventors: Ryan M. Stokke, Anthem, AZ (US); Martin R. Jertson, Cave Creek, AZ (US); Brandon L. Fossum, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 28 days.

(21) Appl. No.: 16/984,795

(22) Filed: Aug. 4, 2020

(65) Prior Publication Data

US 2020/0360773 A1 Nov. 19, 2020

Related U.S. Application Data

(63) Continuation of application No. 15/209,061, filed on Jul. 13, 2016, now Pat. No. 10,729,945, which is a continuation of application No. 14/043,735, filed on Oct. 1, 2013, now Pat. No. 9,403,070.

(51) Int. Cl.
*A63B 53/04* (2015.01)

(52) U.S. Cl.
CPC ..... *A63B 53/0466* (2013.01); *A63B 53/04* (2013.01); *A63B 53/045* (2020.08); *A63B 53/0433* (2020.08); *A63B 53/0437* (2020.08); *A63B 53/0462* (2020.08); *Y10T 29/49826* (2015.01)

(58) Field of Classification Search
CPC ... A63B 53/0466; A63B 53/04; A63B 53/045; A63B 53/0462; A63B 53/0437; A63B 53/0433
See application file for complete search history.

(56) References Cited

U.S. PATENT DOCUMENTS

| | | | | |
|---|---|---|---|---|
| 1,133,129 | A | 3/1915 | Govan | |
| 3,606,327 | A | 9/1971 | Gorman | |
| 5,492,327 | A | 2/1996 | Biafore, Jr. | |
| 6,193,614 | B1 | 2/2001 | Sasamoto et al. | |
| 6,210,290 | B1 | 4/2001 | Erickson et al. | |
| 6,348,013 | B1 | 2/2002 | Kosmatka | |
| 6,368,232 | B1 | 4/2002 | Hamada et al. | |
| 7,211,006 | B2 | 5/2007 | Chang | |
| 7,226,366 | B2 | 6/2007 | Galloway | |
| 7,294,064 | B2 | 11/2007 | Tsurumaki et al. | |
| 7,297,072 | B2 | 11/2007 | Meyer et al. | |
| 7,318,782 | B2 | 1/2008 | Imamoto et al. | |
| 7,344,452 | B2 | 3/2008 | Imamoto et al. | |
| 7,347,795 | B2 * | 3/2008 | Yamagishi ..... | A63B 53/0466 473/345 |
| 7,438,649 | B2 * | 10/2008 | Ezaki ..... | A63B 53/0466 473/345 |
| 7,470,201 | B2 | 12/2008 | Nakahara et al. | |
| 7,500,924 | B2 | 3/2009 | Yokota | |
| 7,549,933 | B2 | 6/2009 | Kumamoto | |

(Continued)

FOREIGN PATENT DOCUMENTS

| | | |
|---|---|---|
| JP | 2002052099 | 2/2002 |
| JP | 2003093554 | 4/2003 |

*Primary Examiner* — William M Pierce

(57) ABSTRACT

Golf club heads with trench features are described herein. Other embodiments and related methods are also disclosed herein.

20 Claims, 9 Drawing Sheets

(56) References Cited

U.S. PATENT DOCUMENTS

| | | | | |
|---|---|---|---|---|
| 7,582,024 | B2 | 9/2009 | Shear | |
| 7,632,196 | B2 | 12/2009 | Reed et al. | |
| 7,857,711 | B2 | 12/2010 | Shear | |
| 8,235,844 | B2 | 8/2012 | Albertsen et al. | |
| 8,241,143 | B2 | 8/2012 | Albertsen et al. | |
| 8,241,144 | B2 | 8/2012 | Abertsen et al. | |
| 8,328,659 | B2 | 12/2012 | Shear | |
| 8,403,771 | B1 | 3/2013 | Rice et al. | |
| 8,517,860 | B2 | 8/2013 | Albertsen et al. | |
| 8,657,703 | B2 | 2/2014 | Wada et al. | |
| 8,845,454 | B2 | 9/2014 | Boyd et al. | |
| 8,900,069 | B2 | 12/2014 | Beach et al. | |
| 8,986,133 | B2 | 3/2015 | Bennett et al. | |
| 9,011,267 | B2 | 4/2015 | Burnett et al. | |
| 9,403,070 | B2 * | 8/2016 | Stokke | A63B 53/0466 |
| 9,421,434 | B2 * | 8/2016 | Takagi | A63B 60/50 |
| 10,322,322 | B2 * | 6/2019 | Frame | A63B 60/54 |
| 10,806,978 | B2 * | 10/2020 | Golden | A63B 53/06 |
| 10,843,046 | B2 * | 11/2020 | Bennett | A63B 53/04 |
| 2002/0137576 | A1 | 9/2002 | Dammen | |
| 2003/0114244 | A1 | 6/2003 | Matsunaga | |
| 2004/0192463 | A1 | 9/2004 | Tsurumaki et al. | |
| 2006/0052177 | A1 * | 3/2006 | Nakahara | A63B 53/0466<br>473/329 |
| 2007/0026961 | A1 | 2/2007 | Hou | |
| 2007/0117648 | A1 | 5/2007 | Yokota | |
| 2011/0021284 | A1 | 1/2011 | Stites et al. | |
| 2012/0142447 | A1 | 6/2012 | Boyd et al. | |
| 2012/0142452 | A1 | 6/2012 | Burnett et al. | |
| 2012/0270676 | A1 | 10/2012 | Burnett et al. | |
| 2012/0277029 | A1 | 11/2012 | Albertsen et al. | |
| 2012/0277030 | A1 | 11/2012 | Albertsen et al. | |
| 2013/0102408 | A1 | 4/2013 | Shear | |
| 2013/0184100 | A1 | 7/2013 | Burnett et al. | |
| 2014/0228148 | A1 | 8/2014 | Soracco | |

* cited by examiner 1000
3150
1110
1111
2350
3321
2310
3329
2320
2300
3311
3312
3313
1121
1100
1120
4123
4122
2250
2210
2220
2200
3229
4125
3211
3221
3213
3212
4126
3900
1131
1130
4225
4223
4222
4620
3311
4640
3313
4630
3312
4610
4530
3211
4540
3212
4510
4520
4126

15000

GOLF CLUB HEADS WITH TRENCH FEATURES AND RELATED METHODS

CROSS REFERENCE

This is a continuation of U.S. patent application Ser. No. 15/209,061, filed on Jul. 13, 2016, and issued as U.S. Pat. No. 10,729,945 on Aug. 4, 2020, which is a continuation of U.S. patent application Ser. No. 14/043,735, filed on Oct. 1, 2013, and issued as U.S. Pat. No. 9,403,070 on Aug. 2, 2016, the entire contents of which are fully incorporated herein by reference.

TECHNICAL FIELD

The present disclosure generally relates to golf equipment and, more particularly, to golf club heads with trench features and related methods.

BACKGROUND

Modern wood-type golf club heads have been developed to accentuate or improve the performance thereof, such as by removing or rearranging mass to desired locations to adjust the location of the club head's center of gravity, and/or by introducing one or more elements, such as a slot, to adjust strikeface response for better golf launch characteristics. Such improvements, however, have to be balanced with the ability of the golf club head to withstand appropriate impact stresses without structural degradation or failures.

Considering the above, further developments with respect to reinforcing appropriate golf club features may enhance the performance of golf clubs while maintaining sufficient structural integrity thereof.

BRIEF DESCRIPTION OF THE DRAWINGS

The present disclosure will be better understood from a reading of the following detailed description of examples of embodiments, taken in conjunction with the accompanying figures in the drawings.

Figure 1:
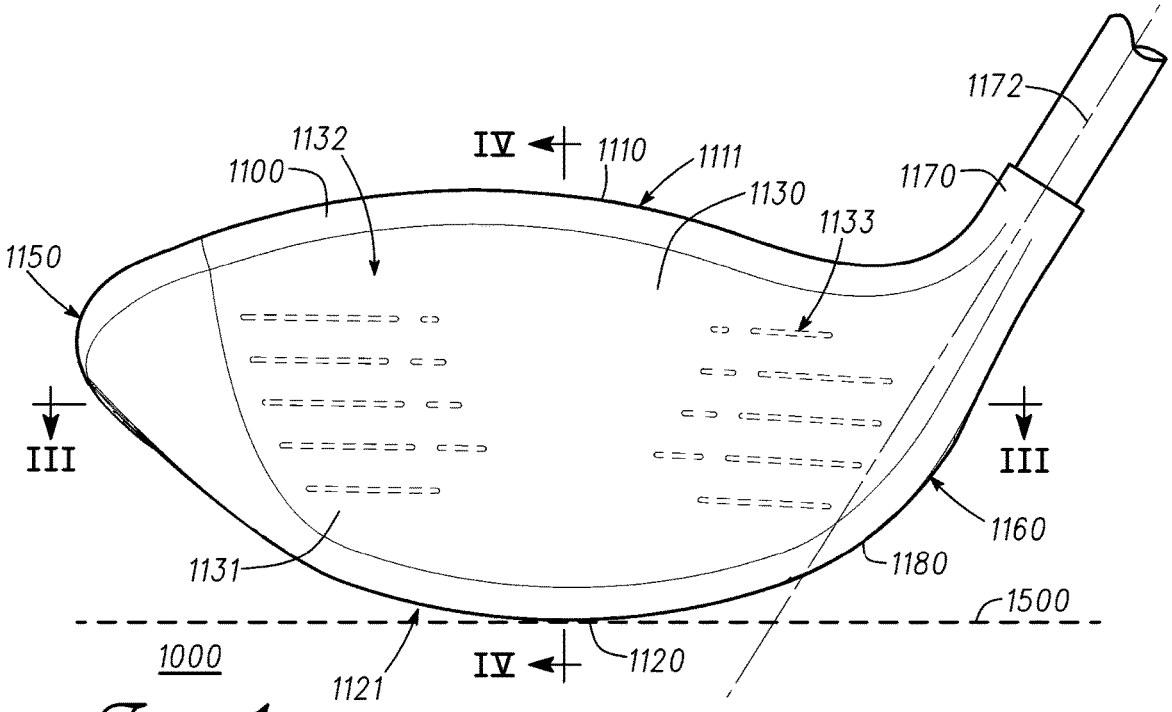
FIG. 1 illustrates a front view of golf a club head.

For simplicity and clarity of illustration, the drawing figures illustrate the general manner of construction, and descriptions and details of well-known features and techniques may be omitted to avoid unnecessarily obscuring the other relevant features or techniques. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling may be for any length of time, e.g., permanent or semi-permanent or only for an instant. The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material. In addition, orthogonality of a line, with respect to a curved line or surface, is measured relative to a straight line or flat surface tangent to such curved line or surface.

DESCRIPTION

In one example, a golf club head can comprise a body and a trench feature at a body section of the body. The body can comprise a sole, a crown, a body heel end, a body toe end, a body front end, and a body rear end. The body section can comprise at least one of the sole or the crown. The trench feature can comprise an inner trench section comprising a trench, and a reinforcement structure protruded from the body section and bounding the inner trench section. The reinforcement structure can comprise a reinforcement inner perimeter adjacent to the inner trench section, a reinforcement outer perimeter opposite the reinforcement inner perimeter and a reinforcement peak protruded between the reinforcement inner perimeter and the reinforcement outer perimeter. The body section can comprise a body section exterior surface defining an exterior body contour of the body section, and a minimum outer thickness, located outside the reinforcement outer perimeter, and measured orthogonal to the exterior body contour. The trench feature can comprise a reinforcement thickness measured, orthogonal to the exterior body contour, from the reinforcement peak to the exterior body contour, and a reinforcement girth measured, orthogonal to the reinforcement thickness, between the reinforcement inner perimeter and the reinforcement outer perimeter. The reinforcement structure can protrude past the minimum outer thickness. The reinforcement structure can protrude past the inner trench section. The reinforcement girth can be at least approximately 1.5 times greater than the minimum outer thickness.

In one implementation, a golf club head can comprise a body and a trench feature at a body section of the body. The body can comprise a sole, a crown, a body heel end, a body toe end, a body front end, and a body rear end. The body section can comprise at least one of the sole or the crown. The trench feature can comprise an inner trench section comprising a trench, and a reinforcement structure protruded from the body section and bounding the inner trench section. The reinforcement structure can comprise a reinforcement inner perimeter adjacent to the inner trench section, a reinforcement outer perimeter opposite the reinforcement inner perimeter and a reinforcement peak protruded between the reinforcement inner perimeter and the reinforcement outer perimeter. The body section can comprise a body section exterior surface defining an exterior body contour of the body section, and a minimum outer thickness, located outside the reinforcement outer perimeter, and measured orthogonal to the exterior body contour. The trench feature can comprise a reinforcement thickness measured, orthogonal to the exterior body contour, from the reinforcement peak to the exterior body contour, and a reinforcement girth measured, orthogonal to the reinforcement thickness, between the reinforcement inner perimeter and the reinforcement outer perimeter. The reinforcement structure can protrude past the minimum outer thickness. The reinforcement structure can protrude past the inner trench section. The reinforcement thickness can be at least approximately 3 times greater than the minimum outer thickness.

In one implementation, a method can comprise providing a body of a golf club head, and providing a trench feature at a body section of the body. The body can comprise a sole, a crown, a body heel end, a body toe end, a body front end, and a body rear end. The body section can comprise at least one of the sole or the crown. The trench feature can comprise an inner trench section comprising a trench, and a reinforcement structure protruded from the body section and bounding the inner trench section. The reinforcement structure can comprise a reinforcement inner perimeter adjacent to the inner trench section, a reinforcement outer perimeter opposite the reinforcement inner perimeter and a reinforcement peak protruded between the reinforcement inner perimeter and the reinforcement outer perimeter. The body section can comprise a body section exterior surface defining an exterior body contour of the body section, and a minimum outer thickness, located outside the reinforcement outer perimeter, and measured orthogonal to the exterior body contour. The trench feature can comprise a reinforcement thickness measured, orthogonal to the exterior body contour, from the reinforcement peak to the exterior body contour, and a reinforcement girth measured, orthogonal to the reinforcement thickness, between the reinforcement inner perimeter and the reinforcement outer perimeter. The reinforcement structure can protrude past the minimum outer thickness. The reinforcement structure can protrude past the inner trench section. The reinforcement girth can be at least approximately 1.5 times greater than the minimum outer thickness.

Other examples and embodiments are further disclosed herein. Such examples and embodiments may be found in the figures, in the claims, and/or in the present description.

Figure 2:
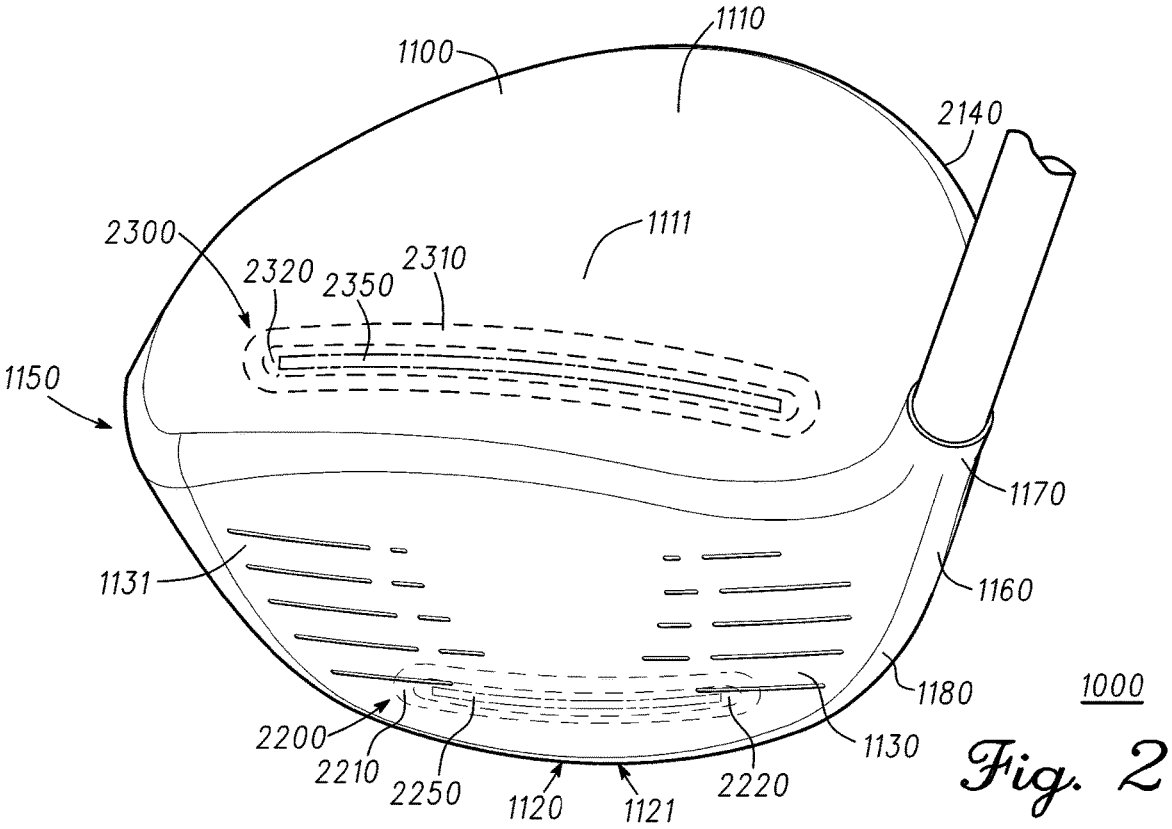
FIG. 2 illustrates a front side perspective X-ray view of the golf club head of FIG. 1, showing exemplary trench features thereof.
Figure 3:
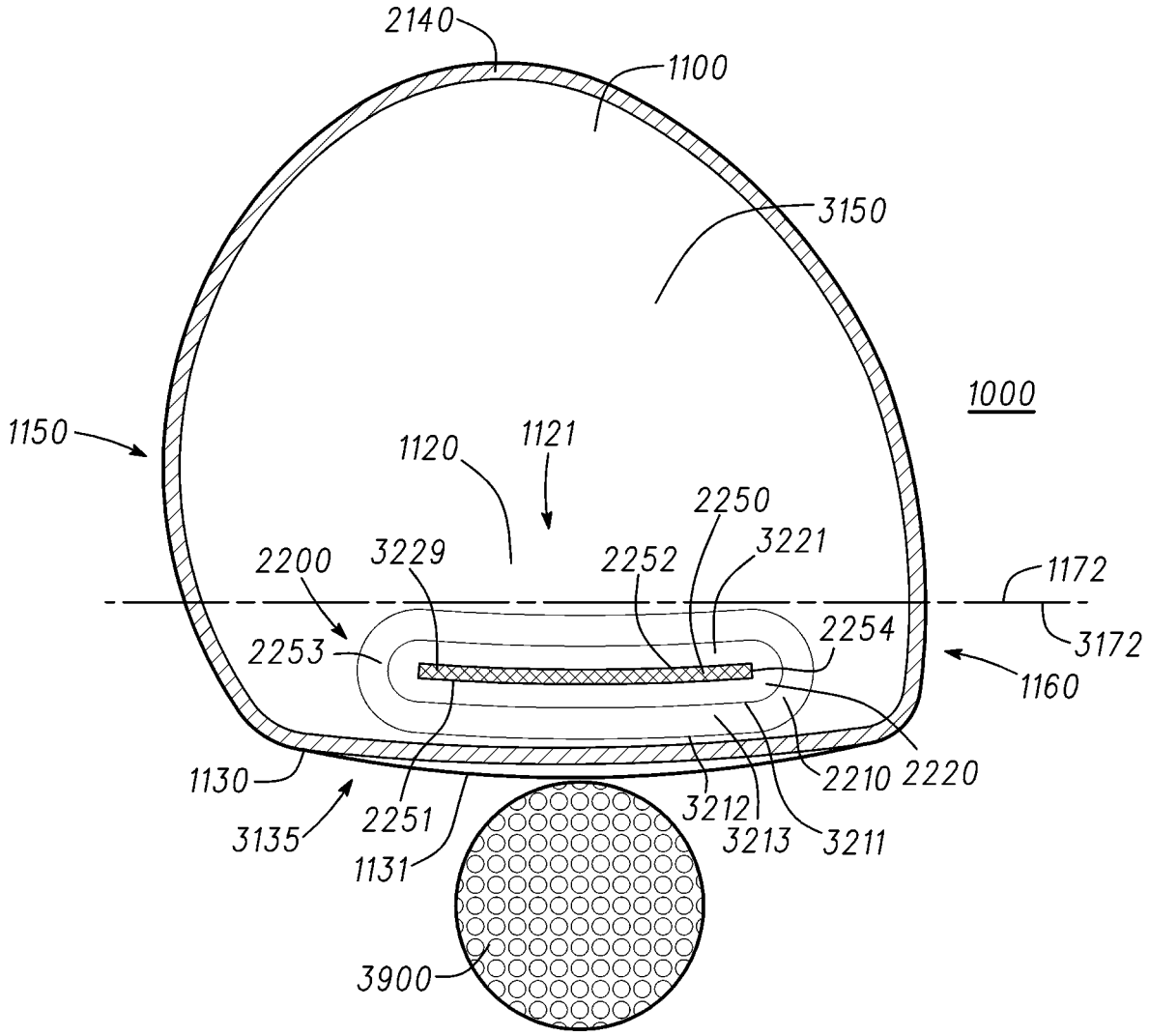
FIG. 3 illustrates a cross-sectional bottomward view of the golf club head of FIG. 1 along line III-III thereof.
Figure 4:
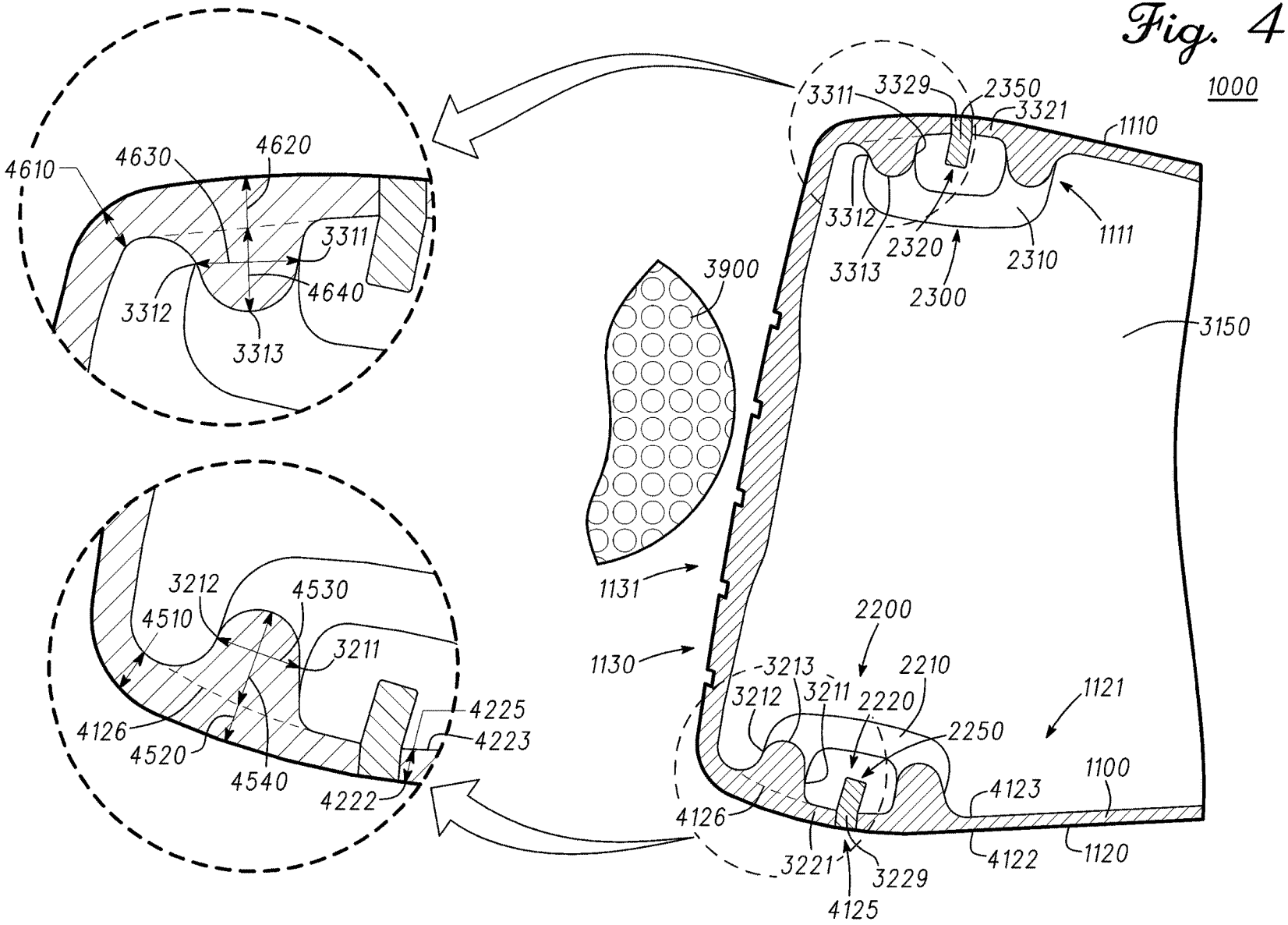
FIG. 4 illustrates a cross-sectional heelward view of the golf club head of FIG. 1 along line IV-IV thereof.

FIG. 1 illustrates a front view of golf club head 1000. FIG. 2 illustrates a front side perspective X-ray view of golf club head 1000, showing exemplary trench features 2200 and 2300 located at head body 1100 thereof. FIG. 3 illustrates a cross-sectional bottomward view of golf club head 1000 along line of FIG. 1. FIG. 4 illustrates a cross-sectional heelward view of golf club head 1000 along line IV-IV of FIG. 1.

Head body 1100 comprises crown 1110, sole 1120, body heel end 1160, body toe end 1150, body front end 1130, body rear end 2140, hosel 1170, and skirt 1180 in the present embodiment, where body front end 1130 comprises strikeface 1131 with strikeface toe portion 1132 and strikeface heel portion 1133. Trench features 2200 and 2300 protrude from corresponding body sections of head body 1100 into the hollow cavity of head body 1100. For example, trench features 2200 and 2300 can include trenches 2250 and 2350, respectively. Furthermore, trench feature 2300 can be located at body section 1111, which comprises crown 1110, while trench feature 2200 can be located at body section 1121, which comprises sole 1120. There can be other embodiments where trench features 2200 and/or 2300 can extend to skirt 1180, such that body sections 1121 and/or 1111 can comprise skirt 1180, as well. Although the present embodiment of club head 1000 comprises both trench feature 2300 at crown 1110 and trench feature 2200 at sole 1120, there can be other embodiments where trench feature 2300 at crown 1110 can be absent, or where trench feature 2200 at sole 1200 can be absent. There also can be other embodiments with one or more trench features, that can be similar to one or more of the trench features described herein, but protruding to an exterior of head body 1100 instead of, or in addition to, protruding into the hollow cavity of head body 1100.

Figure 5:
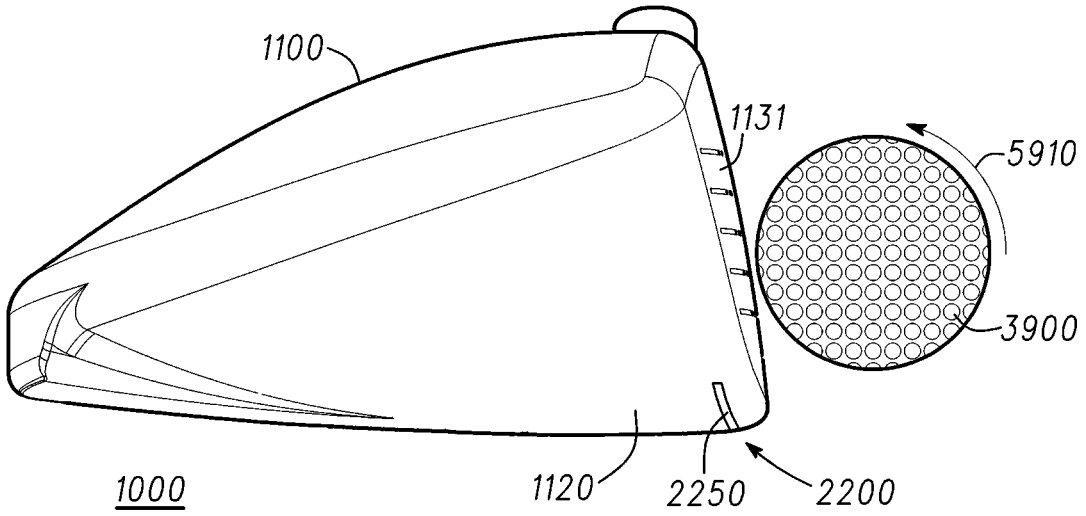
FIG. 5 illustrates a side view of the golf club head of FIG. 1 during initial impact of a golf ball, showing in how a trench at the sole thereof is compressed by such impact.
Figure 6:
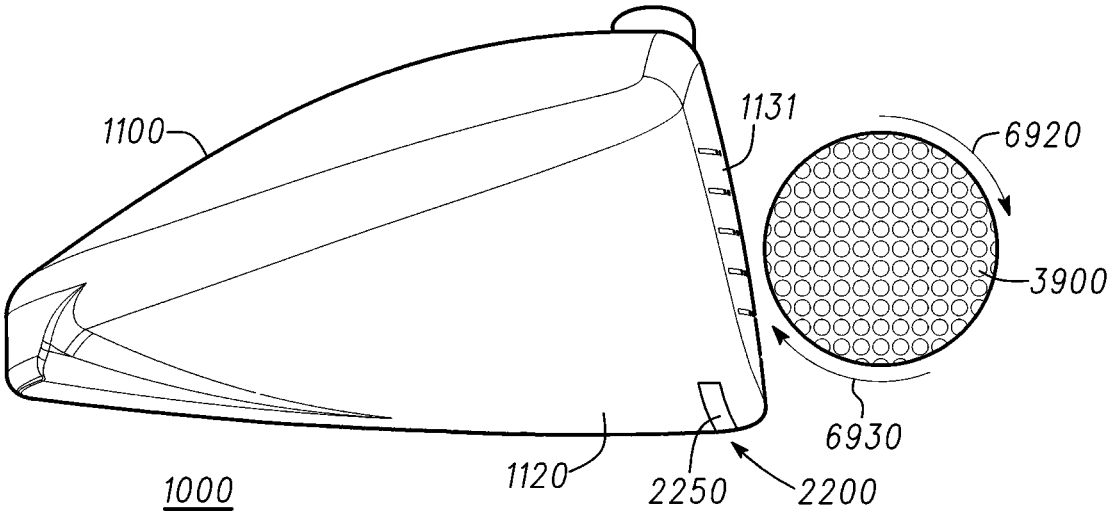
FIG. 6 illustrates a side view the golf club head of FIG. 1 upon decompression of the trench at the sole, following the compression thereof shown in FIG. 5.

Trench features 2200 and/or 2300 can be configured to alter or adjust golf ball launch characteristics upon impact of strikeface 1131 with a golf ball 3900. Skipping ahead in the figures, FIG. 5 illustrates a side view of golf club head 1000 during initial impact of golf ball 3900 at a lower portion of strikeface 1131, showing in X-ray how trench 2250 of trench feature 2200 is compressed by such impact, thereby decreasing the effective loft angle of golf club head 1000 and thus decreasing the launch angle for golf ball 3900. Backspin 5910 is normally induced onto golf ball 3900 as a result of gearing effect with strikeface 1131 during impact therewith. However, the provision of trench feature 2200 can decrease such backspin as seen in FIG. 6, which illustrates a side view of golf club head 1000 upon decompression of trench 2250 following the compression thereof shown in FIG. 5. In particular, as trench 2250 decompresses forward towards strikeface 1131 in FIG. 6, counterspin 6920 is induced onto golf ball 3900, where such counterspin 6920 counteracts at least a portion of backspin 5910 in FIG. 5 to thus yield resulting spin 6930 with less backspin than backspin 5910 in FIG. 5. Accordingly, the provision of trench feature 2200 with trench 2250 at sole 1120 can permit lower launch angles and reduced backspin for golf ball 3900 as described above with respect to FIGS. 5-6, and due to the decompression of trench 2250, launch speed for golf ball 3900 can be increased as well.

Figure 7:
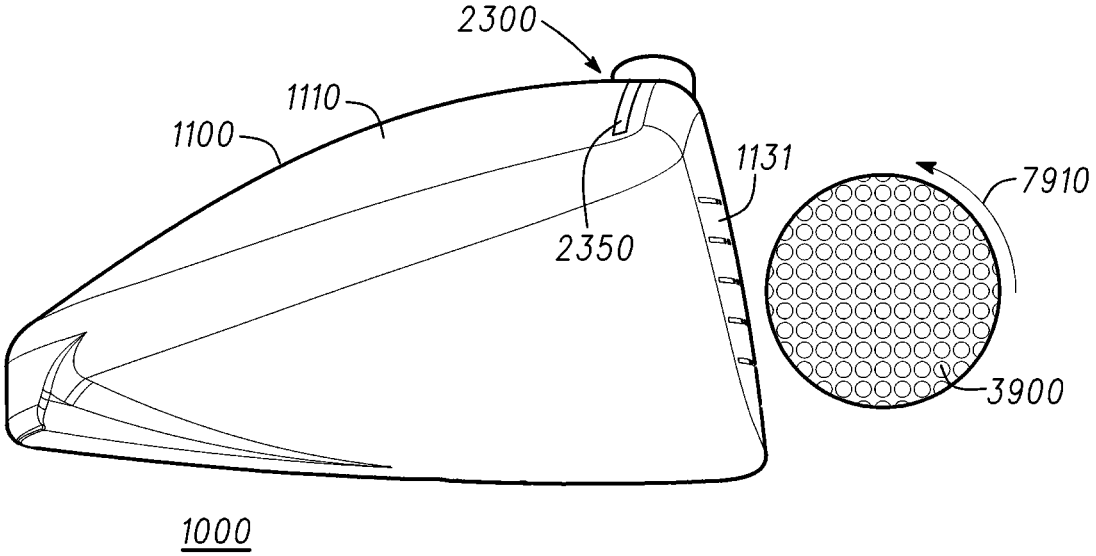
FIG. 7 illustrates a side view of the golf club head of FIG. 1 during initial impact of the golf ball, showing in how a trench at the crown thereof is compressed by such impact.
Figure 8:
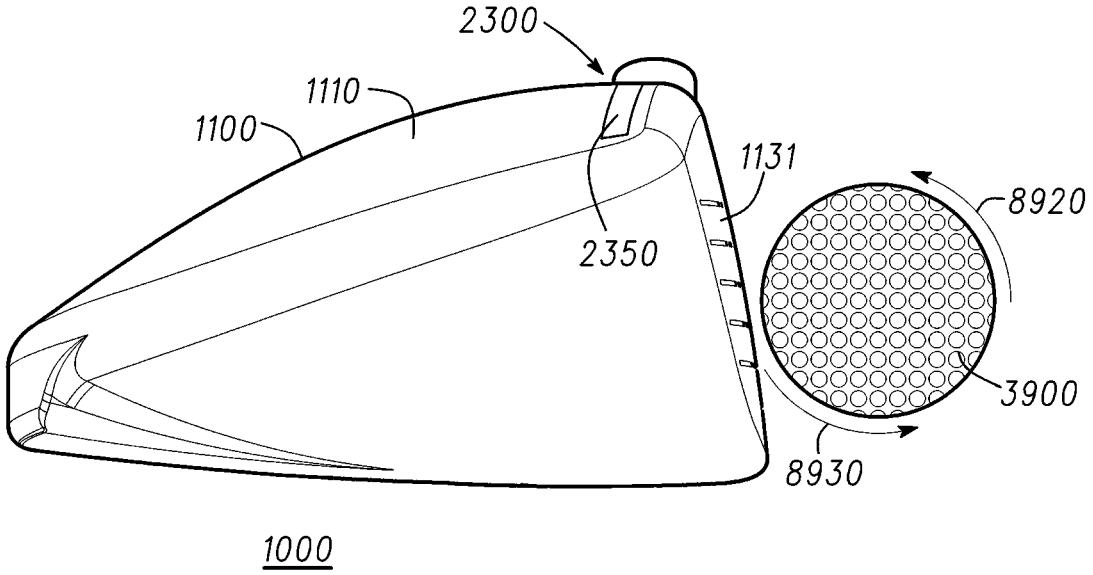
FIG. 8 illustrates a side view the golf club head of FIG. 1 upon decompression of the trench at the crown, following the compression thereof shown in FIG. 7.

FIG. 7 illustrates a side view of golf club head 1000 during initial impact of golf ball 3900 at an upper portion of strikeface 1131, showing in X-ray how trench 2350 of trench feature 2300 is compressed by such impact, thereby increasing the effective loft angle of golf club head 1000 and thus increasing the launch angle for golf ball 3900. Backspin 7910 can be similar to backspin 5910 (FIG. 5), and is normally induced onto golf ball 3900 as a result of gearing effect with strikeface 1131 during impact therewith. However, the provision of trench feature 2300 at crown 1110 can increase such backspin as seen in FIG. 8, which illustrates a side view of golf club head 1000 upon decompression of trench 2350 following the compression thereof shown in FIG. 7. In particular, as trench 2350 decompresses forward towards strikeface 1131 in FIG. 8, spin 8920 is induced onto golf ball 3900, where such spin 8920 adds to backspin 7910 in FIG. 7 to yield resulting spin 8930 comprising greater backspin than backspin 7910 in FIG. 7. Accordingly, the provision of trench feature 2300 with trench 2350 at crown 1110 can permit greater launch angles and increased backspin for golf ball 3900 as described above with respect to FIGS. 7-8, and due to the decompression of trench 2350, launch speed for golf ball 3900 can be increased as well.

Figure 9:
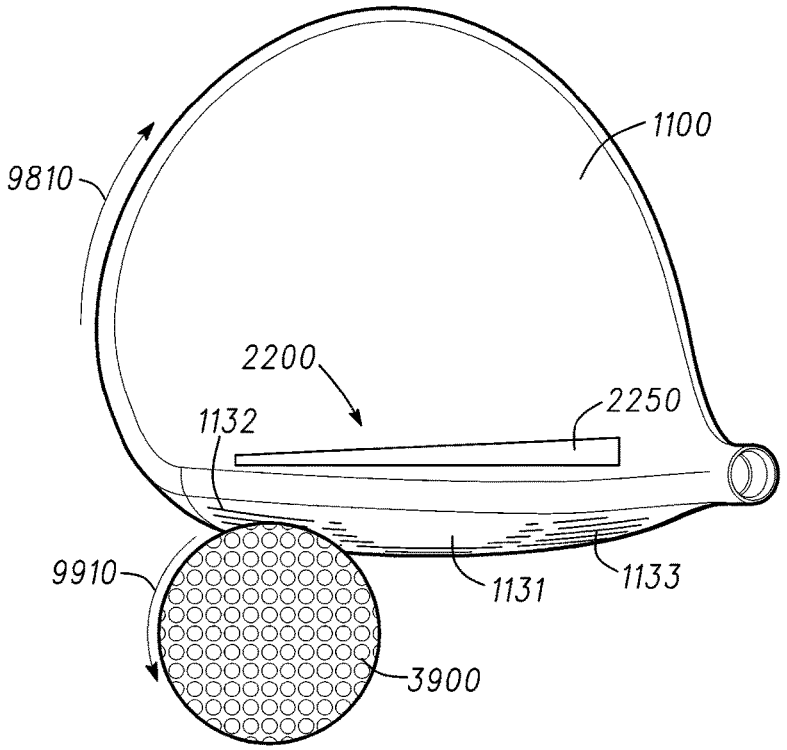
FIG. 9 illustrates a top view of the golf club head of FIG. 1 during initial impact of the golf ball at a toe strikeface portion, showing in how a trench thereof is compressed by such impact at its toe portion.
Figure 10:
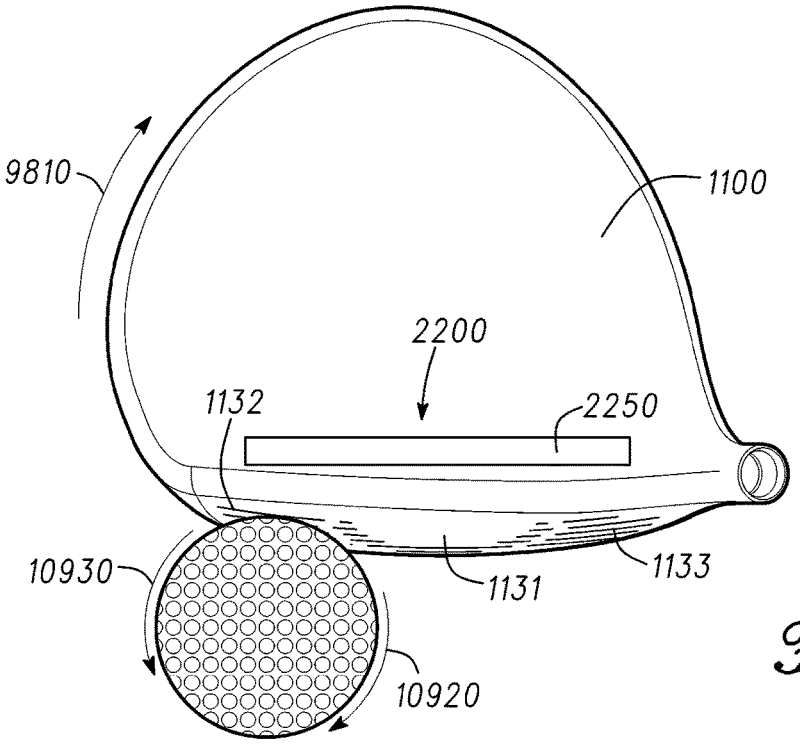
FIG. 10 illustrates a top view of the golf club head of FIG. 1 upon decompression of the trench, following the compression thereof shown in FIG. 9.

FIG. 9 illustrates a top view of golf club head 1000 during initial impact of golf ball 3900 at toe portion 1132 of strikeface 1131, showing in X-ray how trench 2250 of trench feature 2200 is compressed by such impact at toe portion 1132. The impact with golf ball 3900 induces head twist 9810 onto golf club head 1000, which in turn induces sidespin 9910 onto golf ball 3900 as a result of gearing effect with strikeface 1131 during impact therewith. The compression of trench 2250 permits toe portion 1132 of strikeface 1131 to further flex backwards, thus increasing accordingly the effective bulge that ball 3900 encounters from strikeface 1131. The provision of trench feature 2200 can counteract at least a portion of sidespin 9910 as seen in FIG. 10, which illustrates a top view of golf club head 1000 upon decompression of trench 2250 following the compression thereof shown in FIG. 9. In particular, as trench 2250 decompresses forward towards strikeface 1131 in FIG. 10, counterspin 10920 is induced onto golf ball 3900, where such counterspin 10920 is greater due to the increased effective bulge of strikeface 1131 afforded by trench feature 2200, and where such counterspin 10920 counteracts at least a portion of sidespin 9910 in FIG. 9 to thus yield resulting spin 10930 comprising less sidespin than sidespin 9910 in FIG. 9 for a straighter ball flightpath. Also, due to the decompression of trench 2250, launch speed for golf ball 3900 can be increased as well.

Returning to FIGS. 1-4, trench feature 2200 comprises inner trench section 2220 with trench 2250, and reinforcement structure 2210 bounding inner trench section 2220 and protruded from body section 1121 at sole 1120 in the present embodiment. Reinforcement structure 2210 comprises reinforcement inner perimeter 3211 (FIG. 3) located between reinforcement structure 2210 and inner trench section 2220, and also comprises reinforcement outer perimeter 3212 located opposite reinforcement inner perimeter 3211. Reinforcement structure 2210 thus protrudes from body section 1121 to reinforcement peak 3213 located between reinforcement inner perimeter 3211 and reinforcement outer perimeter 3212.

In the present embodiment, strikeface 1131 is non-planar, and comprises horizontal bulge 3135 (FIG. 3). Reinforcement outer perimeter 3212, trench 2250, and/or a front end of reinforcement structure 2210 can be substantially parallel to strikeface 1131. Strikeface 1131 comprises non-planar horizontal bulge 3135 in the present embodiment, but there can be other embodiments where reinforcement outer perimeter 3212, trench 2250, and/or the front end of reinforcement structure 2210 can be substantially straight and/or aligned otherwise with respect to strikeface 1131.

Turning to FIG. 4, body section 1121 comprises body section exterior surface 4122 defining exterior body contour 4125, where exterior body contour 4125 follows the contour of body section 1121 along body section exterior surface 4122 but also extrapolates segments where body section exterior surface 4122 is discontinuous, such as at trench 2250. In addition, body section 1121 comprises body section interior surface 4123 defining interior body contour 4126, where interior body contour 4126 follows the contour of body section 1121 along body section interior surface 4123.

Body section 1121 also comprises minimum outer thickness 4510, which is located outside reinforcement outer perimeter 3212 and is measured orthogonal to exterior body contour 4125. For instance, in the present example, minimum outer thickness 4510 is the minimum thickness of body section 1121 located between body front end 1130 and a front end of reinforcement outer perimeter 3212. There can be other examples, however, where minimum outer thickness 4510 can be the minimum thickness measured elsewhere at body section 1121, but still outside reinforcement outer perimeter 3212 and still orthogonal to exterior body contour 4125.

Trench feature 2200 comprises reinforcement thickness 4520 and reinforcement girth 4530. Reinforcement thickness 4520 is measured, orthogonal to exterior body contour 4125, throughout a thickness distance from reinforcement peak 3213 to exterior body contour 4125. Reinforcement girth 4530 is measured, orthogonal to reinforcement thickness 4520, between reinforcement inner perimeter 3211 and reinforcement outer perimeter 3212. In some examples, reinforcement girth 4530 can be measured from reinforcement inner perimeter 3211 to reinforcement outer perimeter 3212. There also can be implementations where reinforcement girth 4530 can be measured by orthogonally traversing reinforcement thickness 4520 at a location situated at approximately ⅓ of the thickness distance from reinforcement peak 3213 to exterior body contour 4125.

As can be seen in FIG. 4, reinforcement structure 2210 protrudes past minimum outer thickness 4510 of body section 1121, and protrudes past inner trench section 2220 as well. The dimensions of reinforcement structure 2210 can thus increase or be greater than other dimensions of body section 1121, such as to provide additional reinforcement for body section 1121 in situations of mechanical stress like during impact of strikeface 1131 with golf ball 3900. For example, reinforcement structure 2210 can be configured to absorb impact stresses and/or to divert impact stresses that could otherwise affect the structural integrity of body section 1121 at or proximate to trench 2250.

Accordingly, in the present embodiment, reinforcement girth 4530 can be at least approximately 1.5 times greater than minimum outer thickness 4510, and/or reinforcement thickness 4520 can be at least approximately 3 times greater than minimum outer thickness 4510.

In the same or other embodiments, reinforcement girth 4530 can be up to approximately 3 times greater than minimum outer thickness 4510, and/or reinforcement thickness 4520 can be up to approximately 6 times greater than minimum outer thickness 4510. Such limitations in the maximum size of reinforcement girth 4530 and/or reinforcement thickness 4520 can be relevant with respect to limiting the movement of the center of gravity of golf club head 1000 towards front end 1130, and/or with respect to maintaining a desired total weight for golf club head 1000.

In some examples, the dimensions of reinforcement structure 2210 can also be configured with respect to its protrusion relative to body section interior surface 4123 of body section 1121. For instance, trench feature 2200 comprises structure thickness 4540, which is measured orthogonal to exterior body contour 4125, and extends from reinforcement peak 3212 to interior body contour 4123. In some embodiments, structure thickness 4540 can be approximately 100% to approximately 500% of minimum outer thickness 4510.

In the present embodiment, inner trench section 2220 comprises inner section wall 3221 that bounds trench 2250. Interior section wall 3221 comprises wall interior surface 4223 and wall exterior surface 4222, where wall exterior surface 4222 extends along exterior body contour 4125 and comprises a portion of body section exterior surface 4222. Trench 2250 can extend from wall exterior surface 4222 to wall interior surface 4223, such as to fully pierce through inner section wall 3221. There can be other embodiments, however, where trench 2250 can stop short of fully piercing through inner section wall 3221.

Inner trench section 2220 comprises inner section thickness 4225 which, in the present example, is measured orthogonal to exterior body contour 4125 across inner section wall 3221. Reinforcement girth 4530 and/or reinforcement thickness 4520 can be greater than inner section thickness 4225, such as to provide additional structural support therefor. For instance, reinforcement girth 4530 can be at least approximately 4 times greater than inner section thickness 4225, and/or reinforcement thickness 4520 can be at least approximately 5 times greater than inner section thickness 4225 in some implementations.

Golf club head 1000 also comprises shaft axis 1172 (FIG. 1) as defined by hosel 1170 (FIG. 1). Shaft axis 1172 defines shaft axis plane 3172 (FIG. 3), which comprises shaft axis 1172 and is orthogonal to ground plane 1500 (FIG. 1) when golf club head 1000 is at address over ground plane 1500 as shown in FIG. 1. As seen in FIG. 3, one or more, if not all, portions of trench feature 2200, such as a front end of reinforcement structure 2210, a front end of trench 2250, a rear end of trench 2250, and/or a rear end of reinforcement structure 2210, can be located towards body front end 1130 of golf club head 1000, such as between shaft axis plane 3172 and body front end 1130. Such location proximate to strikeface 1131 can be beneficial for increasing the amount of compression of trench 2250 during impact with golf ball 3900, and/or to position reinforcement structure 2210 for better absorbing or dissipating impact stresses related to such impact with golf ball 3900.

As seen in FIGS. 3-4, trench feature 2200 also comprises trench cap 3229, which is located at least partially within trench 2250. Trench cap 3229 can seal trench 2250, for example, to prevent dirt from entering interior cavity 3150 of golf club head 1000 and/or to comply with regulations from one or more golf governing bodies. In some examples, trench cap 3229 can comprise a material having a specific gravity less than approximately 2 and/or a hardness of approximately 90 shore A or softer. In the same or other examples, the material of trench cap 3229 can comprise one or more of a rubber material, a urethane material, and/or a silicon material, among others.

As previously discussed above, and as shown in FIGS. 2 and 4, golf club head 1000 also comprises trench feature 2300 at body section 1111, where body section 1111 comprises crown 1110 in the present embodiment. Trench feature 2300 is similar to trench feature 2200, but is located at crown 1110 rather than at sole 1120. The different elements of trench features 2200 and 2300 can be correspondingly similar to each other. For example, reinforcement structure 2310, reinforcement outer perimeter 3312, reinforcement inner perimeter 3311, reinforcement peak 3313, inner trench section 2320, inner section wall 3321, trench 2350, minimum outer thickness 4610, reinforcement thickness 4620, reinforcement girth 4630, structure thickness 4640, and trench cap 3329 for trench feature 2300 at crown 1110 can be correspondingly similar to reinforcement structure 2210, reinforcement outer perimeter 3212, reinforcement inner perimeter 3211, reinforcement peak 3213, inner trench section 2220, inner section wall 3221, trench 2250, minimum outer thickness 4510, reinforcement thickness 4520, reinforcement girth 4530, structure thickness 4540, and trench cap 3229 for trench feature 2200 at sole 1120 as described above.

In the example of FIGS. 1-4, reinforcement structure 2210 continuously surrounds trench 2250 throughout trench front end 2251, trench rear end 2252, trench toe end 2253, and trench heel end 2254 thereof. There can be other embodiments similar thereto, however, but with trench structure(s) that need not fully surround trench 2250.

Figure 11:
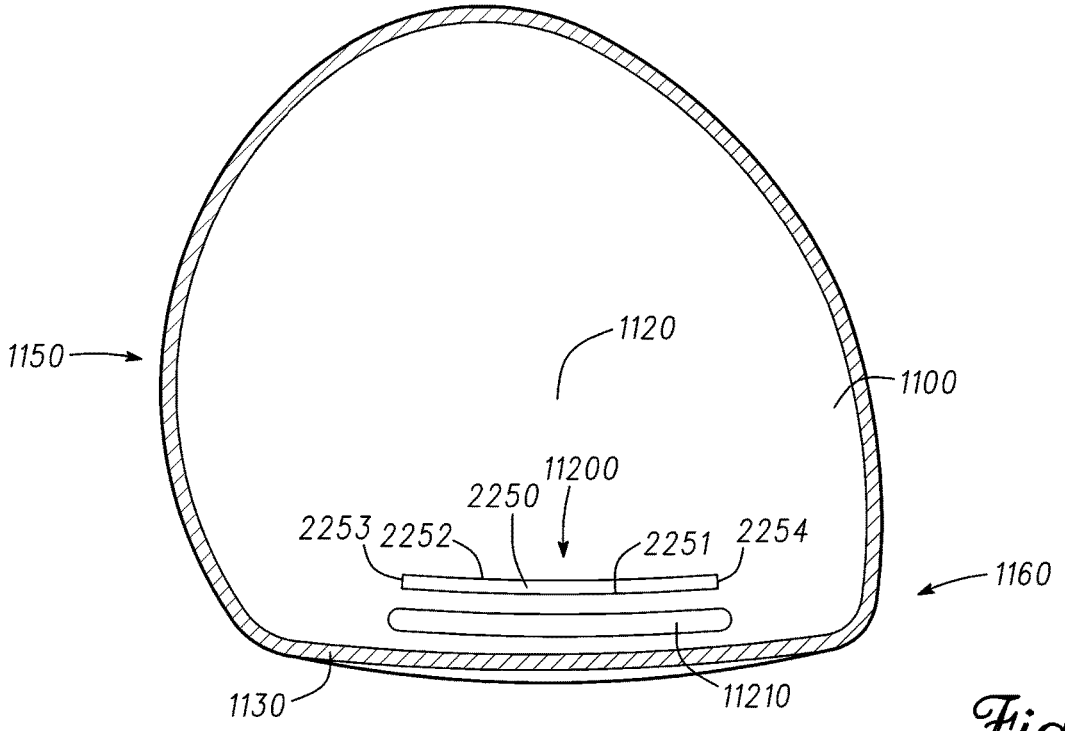
FIG. 11 illustrates a top a cross-sectional bottomward view of another golf club with a corresponding trench feature.

For instance, FIG. 11 illustrates a top a cross-sectional bottomward view of golf club head 11000, similar to the perspective described above for FIG. 3. Golf club head 11000 can be similar to golf club head 1000 (FIGS. 1-10), but comprises trench feature 11200 with reinforcement structure 11210 and trench 2250. Reinforcement structure 11210 can be similar to reinforcement structure 2210 (FIGS. 1-4), but does not completely surround trench 2250. Instead, reinforcement structure 11210 is located between body front end 1130 and trench front end 2251, and continuously extends forward of an entirety of trench front end 2251.

Figure 12:
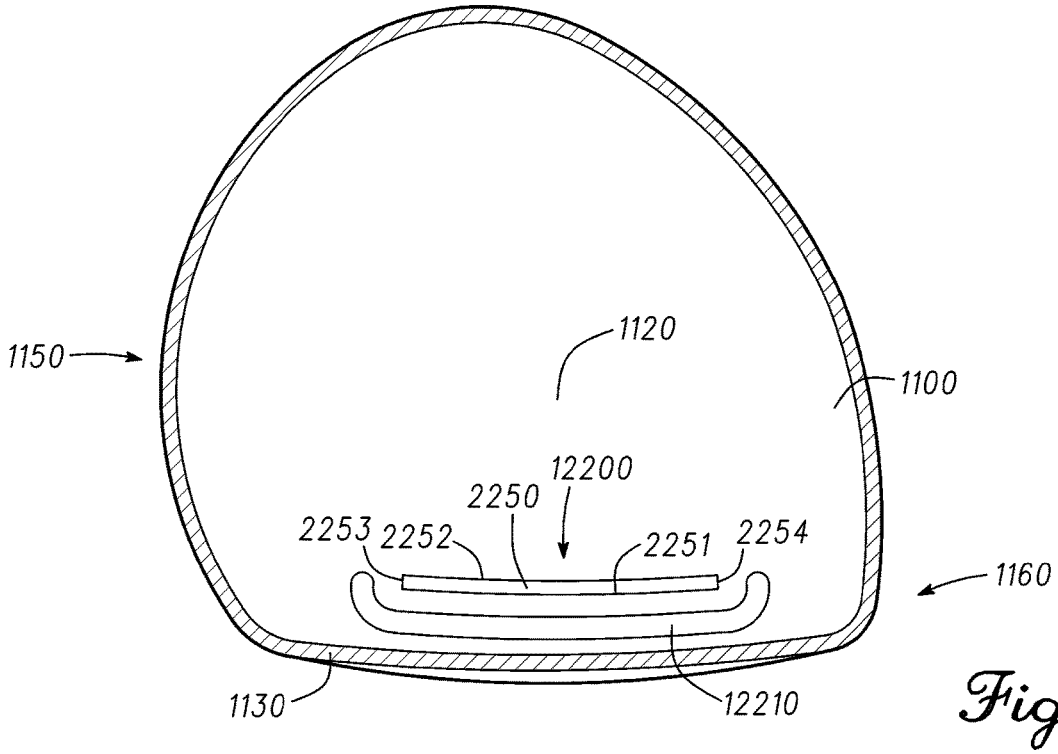
FIG. 12 illustrates a top a cross-sectional bottomward view of another golf club with a corresponding trench feature.

As another example, FIG. 12 illustrates a top a cross-sectional bottomward view of golf club head 12000, similar to the perspective described above for FIG. 3. Golf club head 12000 can be similar to golf club head 1000 (FIGS. 1-10), but comprises trench feature 12200 with reinforcement structure 12210 and trench 2250. Reinforcement structure 12210 can be similar to reinforcement structure 2210 (FIGS. 1-4) and reinforcement structure 11210 (FIG. 11), but can differ in terms of how it bounds trench 2250. For example, reinforcement structure 12210 does not completely surround trench 2250, but does extends toward body toe end 1150 and body heel end 1160 and eventually towards the rear of golf club head 12000 so that portions of reinforcement structure 12210 are located between trench heel end 2254 and body heel end 1160, and between trench toe end 2253 and body toe end 1150.

Figure 13:
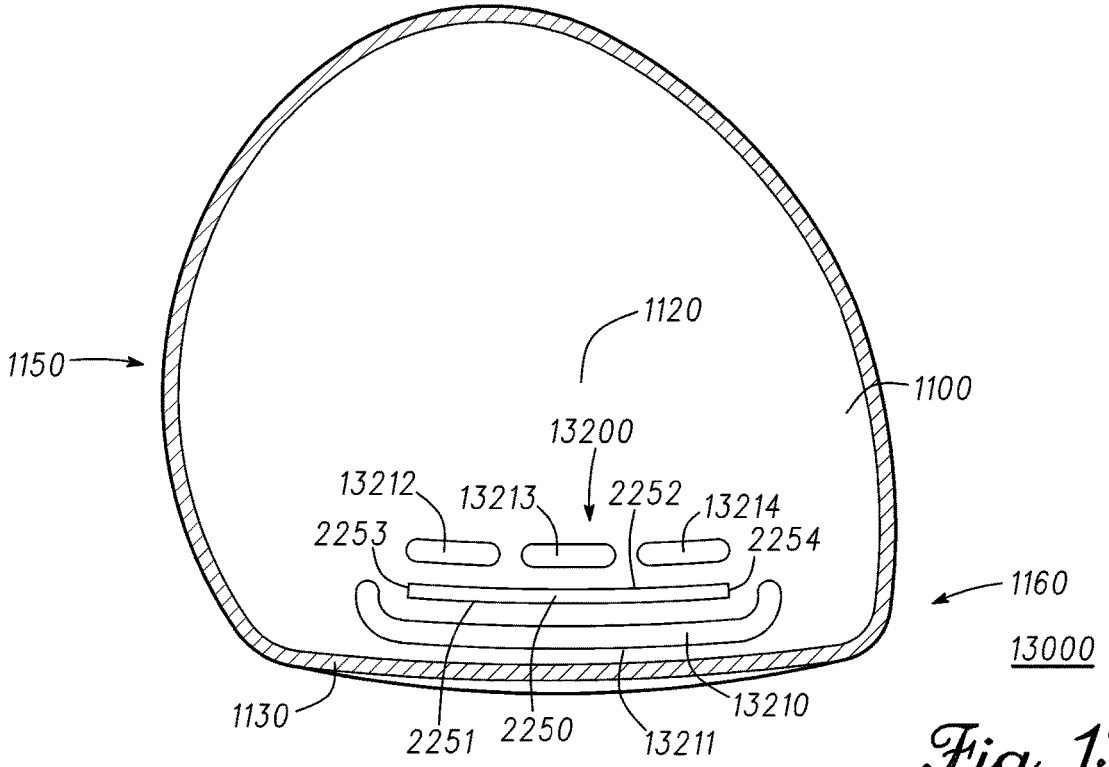
FIG. 13 illustrates a top a cross-sectional bottomward view of another golf club with a corresponding trench feature.

FIG. 13 presents another example illustrating a top cross-sectional bottomward view of golf club head 13000, similar to the perspective described above for FIG. 3. Golf club head 13000 can be similar to golf club head 1000 (FIGS. 1-10), but comprises trench feature 13200 with reinforcement structure 13210 and trench 2250. Reinforcement structure 13210 comprises several separate sections including front reinforcement section 13211, and rear reinforcement sections 13212, 13213, and 13214. Front reinforcement section 13211 and rear reinforcement sections 13212, 13213, and 13214 can be similar to the reinforcement sections described herein with respect to FIGS. 1-12, but can be located elsewhere with respect to trench 2250. For example, front reinforcement section 13211 is located between body front end 1130 and trench front end 2251, while rear reinforcement sections 13212, 13213, and 13214 are located between trench rear end 2252 and the rear or golf club head 1300. There can be examples that can comprise more or less rear reinforcement sections, however.

Figure 14:
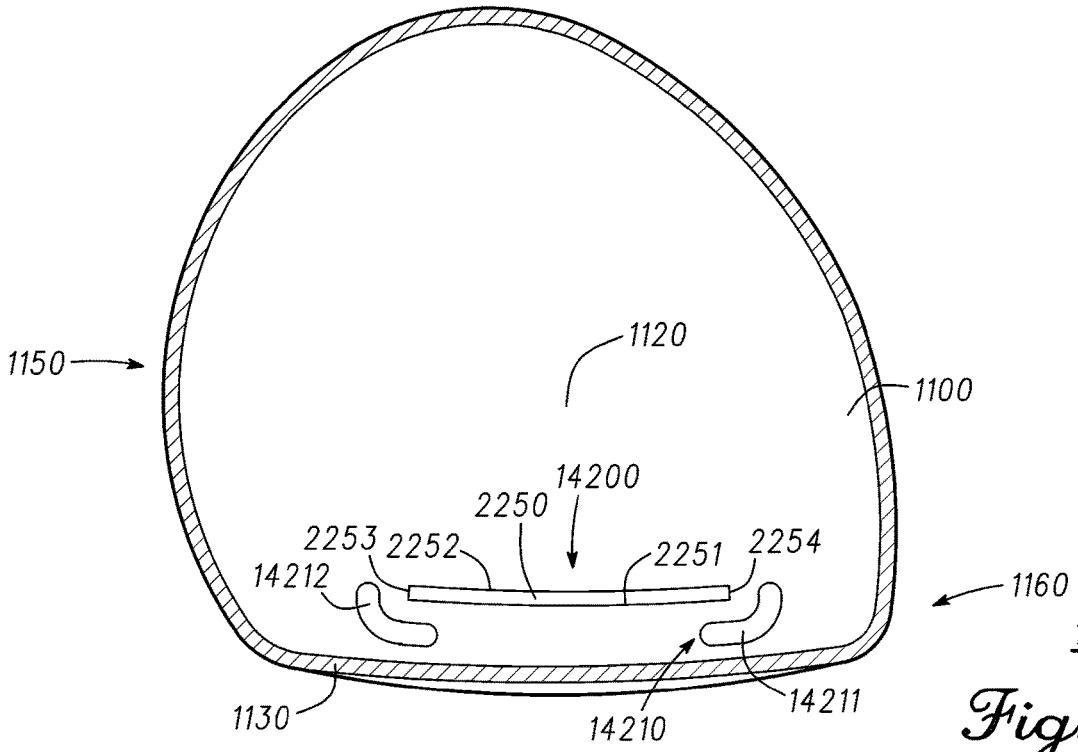
FIG. 14 illustrates a top a cross-sectional bottomward view of another golf club with a corresponding trench feature.

FIG. 14 presents another example illustrating a top a cross-sectional bottomward view of golf club head 14000, similar to the perspective described above for FIG. 3. Golf club head 14000 can be similar to golf club head 1000 (FIGS. 1-10), but comprises trench feature 14200 with reinforcement structure 14210 and trench 2250. Reinforcement structure 14210 comprises front-heel reinforcement segment 14211 located between trench heel end 2254 and at least one of body front end 1130 or body heel end 1160, and also comprises front-toe reinforcement segment 14212 located between trench toe end 2253 and at least one of body front end 1130 or body toe end 1150. In the present example, however, front-heel reinforcement segment 14211 and front-toe reinforcement segment 14212 are separated from each other. For instance, reinforcement structure 14210 can be absent from in front of a majority of trench front end 2251. As another example, reinforcement structure 14210 can comprise a reinforcement thickness similar to reinforcement thickness 4520 (FIG. 4), where such reinforcement thickness can vary such as to be greater at front-toe reinforcement segment 14212 and front-heel reinforcement segment 14211 than elsewhere.

Figure 15:
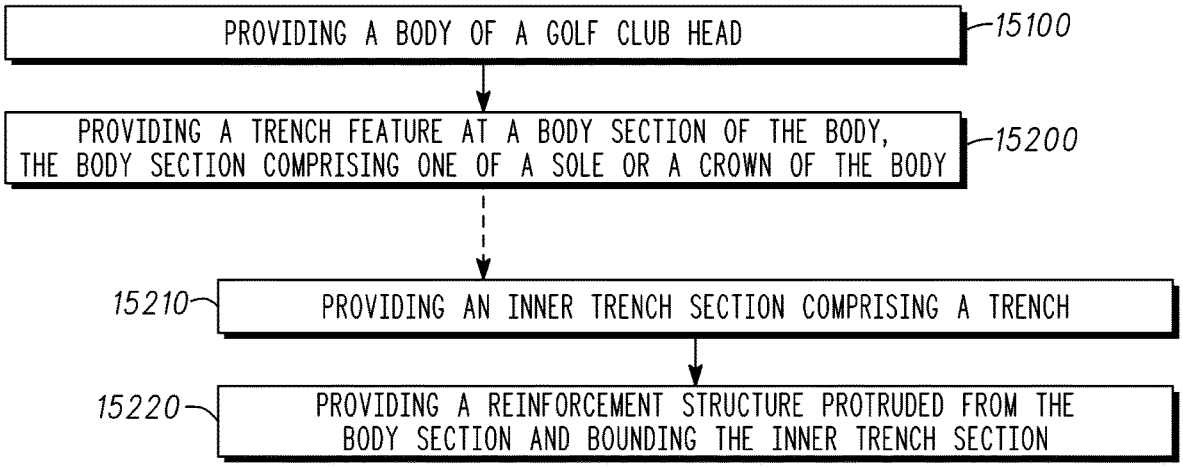
FIG. 15 illustrates a flowchart of a method for providing a golf club head with a trench feature in accordance with examples and embodiments of the present disclosure.

FIG. 15 illustrates a flowchart of a method 15000 for providing a golf club head. In some examples, the golf club head can be similar to one or more of the golf club heads previously described, such as golf club head 1000 (FIGS. 1-10), golf club head 11000 (FIG. 11), golf club head 12000 (FIG. 12), golf club head 13000 (FIG. 13), golf club head 14000 (FIG. 14), and/or variations thereof.

Block 15100 of method 15000 involves providing a body of the golf club head. In some examples, the body can be similar to body 1100 as described above with respect to the embodiments of FIGS. 1-14 and can comprise a crown similar to crown 1110 (FIGS. 1, 2, 4) and a sole similar to sole 1120 (FIGS. 1-4, 11-14).

Block 15200 of method 15000 comprises providing a trench feature at a body section of the body, the body section comprising one of a sole or a crown of the body. In some examples, the trench feature can be similar to trench feature 2200 (FIGS. 2-6, 9-10), trench feature 2300 (FIGS. 2, 4, 7, 8), trench feature 11200 (FIG. 11), trench feature 12200 (FIG. 12), trench feature 13200 (FIG. 13), trench feature 14200 (FIG. 14), and/or variations thereof.

Block 15200 can comprise one or more sub-blocks. For example, sub-block 15210 involves providing a inner trench section of the trench feature, the trench section comprising the trench. In some examples, the inner trench section can be similar to inner trench section 2220 (FIGS. 2-4), inner trench section 2320 (FIGS. 2, 4), and/or to any of the inner trench sections of the embodiments of FIGS. 11-14. In the same or other examples, the trench can be similar to trench 2250 (FIGS. 2-6, 9-14) or trench 2350 (FIGS. 2, 4, 7, 8). The trench can comprise an entirety of the inner trench section, or can be bounded at least partially by an inner section wall similar to inner section wall 3221 (FIGS. 3-4) or inner section wall 3321 (FIG. 4).

Sub-block 15220 can comprise providing a reinforcement structure protruded from the body section and bounding the inner trench section. In some examples, the reinforcement structure can be similar to reinforcement structure 2210 (FIGS. 2-4), reinforcement structure 2310 (FIGS. 2, 4), reinforcement structure 11210 (FIG. 11), reinforcement structure 12210 (FIG. 12), reinforcement structure 13210 (FIG. 13), reinforcement structure 14210 (FIG. 14), and/or variations thereof.

There can be examples where different blocks of method 15000 can be combined into a single block or performed simultaneously, and/or where the sequence of such blocks can be changed. For instance, blocks 15100 and 15200 can be carried out simultaneously, such as where the trench feature is formed integral with the body of the golf club head. There can also be examples where method 15000 can comprise further or different blocks. As an example, method 15000 can comprise another block for coupling a golf club shaft to a hosel of the golf club head. Other variations can be implemented for method 15000 without departing from the scope of the present disclosure.

Although the golf club heads with trench features and related methods herein have been described with reference to specific embodiments, various changes may be made without departing from the spirit or scope of the present disclosure. As an example, trench features and/or reinforcement structures similar to the ones described herein can protrude externally rather than, or in addition to, internally to the golf club head. As another example, although inner trench section 2220 is illustrated in FIGS. 3-4 herein with inner section wall bounding trench 2250 (FIGS. 3-4), there can be examples where trench 2250 can comprise an entirety of inner trench section 2220 and/or can extend to reinforcement inner perimeter 3211, such that inner section wall 3221 and/or inner section thickness 4225 can be absent in such implementations. In addition, although the reinforcement features of FIGS. 11-14 are illustrated with respect to sole 1120, similar reinforcement feature embodiments can be implemented at crown 1110 instead or as well.

Additional examples have been given in the foregoing description. Other permutations of the different embodiments having one or more of the features of the various figures are likewise contemplated. Accordingly, the disclosure herein is intended to be illustrative and is not intended to be limiting. It is intended that the scope of this application shall be limited only to the extent required by the appended claims.

The golf club heads with trench features and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:

a body comprising a sole, a crown, a body heel end, a body toe end, a body front end, and a body rear end; and a trench feature at a body section of the body, the body section comprising:

at least one of the sole or the crown; and a body section exterior surface defining an exterior body contour of the body section, wherein the body section exterior surface comprises at least one discontinuous segment at the trench feature and extrapolates the at least one discontinuous segment at the trench feature;

wherein:

the trench feature comprises:

a trench cap in the at least one discontinuous segment;

an inner trench section comprising a trench and an inner section wall at least partially bounding the trench;

a reinforcement structure coupled to the body section and wherein the reinforcement structure does not extend entirely around the trench feature and is discontinuous at one or more body section regions;

wherein the reinforcement structure is separated from the trench and the trench cap by the inner section wall;

the reinforcement structure comprises:

a reinforcement inner perimeter;

a reinforcement outer perimeter opposite the reinforcement inner perimeter; and a reinforcement peak protruded between the reinforcement inner perimeter and the reinforcement outer perimeter; and a reinforcement thickness that is greater than an inner section wall thickness.

2. The golf club head of claim 1, wherein:

the body further comprises a skirt and the trench feature extends to the skirt.

3. The golf club head of claim 1, wherein:

the reinforcement structure is absent from in front of a majority of a trench front end.

4. The golf club head of claim 1, wherein:

the reinforcement structure comprises a front reinforcement segment located between a body front end of the body section and a trench front end of the trench feature; and the front reinforcement segment continuously extends forward of an entirety of the trench front end of the trench feature.

5. The golf club head of claim 4, wherein:

the front reinforcement segment further extends:

around a trench toe side of the trench feature and toward a body rear end; and around a trench heel side of the trench feature and toward the body rear end.

6. The golf club head of claim 4, wherein:

the reinforcement structure further comprises one or more rear reinforcement segments, each of the one or more rear reinforcement segments located between a trench rear end of the trench feature and a body rear end.

7. The golf club head of claim 1, wherein:

the reinforcement structure comprises:

a first front reinforcement segment located between a toe side of the trench feature and at least one of a body front end or a body toe end; and a second front reinforcement segment, separate from the first front reinforcement segment, located between a heel side of the trench feature and at least one of the body front end or the body heel end.

8. The golf club head of claim 7, wherein:

a first thickness measured at the first front reinforcement segment is greater than a reinforcement thickness measured at a different location on the reinforcement structure; and the first thickness measured at the first front reinforcement segment is approximately equal to a second thickness measured at the second front reinforcement segment.

9. A golf club head comprising:

a body comprising a sole, a crown, a body heel end, a body toe end, a body front end, and a body rear end; and a trench feature at a body section of the body, the body section comprising:

at least one of the sole or the crown;

a body section exterior surface defining an exterior body contour of the body section, wherein the body section exterior surface comprises at least one discontinuous segment at the trench feature and extrapolates the at least one discontinuous segment at the trench feature; and a minimum outer thickness measured orthogonal to the exterior body contour;

wherein:

the trench feature comprises:

a trench cap in the at least one discontinuous segment;

an inner trench section comprising a trench and an inner section wall at least partially bounding the trench;

a reinforcement structure coupled to the body section and wherein the reinforcement structure does not extend entirely around the trench feature and is discontinuous at one or more body section regions;

wherein the reinforcement structure is separated from the trench and the trench cap by the inner section wall;

the reinforcement structure comprises:

a reinforcement inner perimeter;

a reinforcement outer perimeter opposite the reinforcement inner perimeter, the minimum thickness of the trench feature is located outside the reinforcement outer perimeter;

a reinforcement peak protruded between the reinforcement inner perimeter and the reinforcement outer perimeter;

and a reinforcement thickness measured, orthogonal to the exterior body contour and from the reinforcement peak to the exterior body counter, is at least approximately 3 times greater than the minimum outer thickness;

wherein the reinforcement thickness is greater than an inner section wall thickness.

10. The golf club head of claim 9, wherein:

the body further comprises a skirt and the trench feature extends to the skirt.

11. The golf club head of claim 9, wherein:

the reinforcement structure is absent does not surround at least portions of the trench feature.

12. The golf club head of claim 9, wherein:

the reinforcement structure comprises a front reinforcement segment located between a body front end of a body section and a trench front end of a trench feature; and the front reinforcement segment continuously extends forward of an entirety of the trench front end of the trench feature.

13. The golf club head of claim 12, wherein:

the front reinforcement segment further extends:

around a trench toe side of the trench feature and toward a body rear end; and around a trench heel side of the trench feature and toward the body rear end.

14. The golf club head of claim 12, wherein:

the reinforcement structure further comprises one or more rear reinforcement segments, each of the one or more rear reinforcement segments located between a trench rear end of the trench feature and a body rear end.

15. The golf club head of claim 9, wherein:

the reinforcement structure comprises:

a first front reinforcement segment located between a toe side of the trench feature and at least one of the body front end or a body toe end; and a second front reinforcement segment, separate from the first front reinforcement segment, located between a heel side of the trench feature and at least one of the body front end or the body heel end.

16. The golf club head of claim 15, wherein:

a first thickness measured at the first front reinforcement segment is greater than a reinforcement thickness measured at a different location on the reinforcement structure; and the first thickness measured at the first front reinforcement segment is approximately equal to a second thickness measured at the second front reinforcement segment.

17. The golf club head of claim 15, wherein:

a first thickness measured at the first front reinforcement segment is greater than a reinforcement thickness measured at a different location on the reinforcement structure; and the first thickness measured at the first front reinforcement segment is approximately equal to a second thickness measured at the second front reinforcement segment.

18. The golf club head of claim 12, wherein:

the reinforcement structure further comprises two or more discontinuous rear reinforcement segments, each of the two or more rear reinforcement segments located between a trench rear end of the trench feature and a body rear end.

19. The golf club head of claim 12, wherein:

the reinforcement structure further comprises three or more discontinuous rear reinforcement segments, each of the three or more rear reinforcement segments located between a trench rear end of the trench feature and a body rear end.

20. The golf club head of claim 12, wherein:

the reinforcement structure further comprises a discontinuous rear reinforcement segment, located between a trench rear end of the trench feature and a body rear end.

* * * * *